United States Patent [19]

Smith

[11] Patent Number: 4,881,575

[45] Date of Patent: Nov. 21, 1989

[54] SHOWER HEAD DISPENSING FIXTURE

[76] Inventor: Richard J. Smith, 715 Rose Ave., Pleasanton, Calif. 94566

[21] Appl. No.: 242,600

[22] Filed: Sep. 12, 1988

[51] Int. Cl.[4] ..... F16K 19/00

[52] U.S. Cl. ..... 137/889; 137/893; 239/307; 239/318

[58] Field of Search ..... 137/889, 893; 239/303–307, 310, 318

[56] References Cited

U.S. PATENT DOCUMENTS

| | | | |
|---|---|---|---|
| 2,788,244 | 4/1957 | Gilmour | 137/889 X |
| 2,973,718 | 3/1961 | Deutsch | 137/889 |
| 3,333,601 | 8/1967 | Lofgreen | 137/889 X |
| 4,029,260 | 6/1977 | Herrick | 239/307 X |
| 4,200,206 | 4/1980 | Chase | 137/893 X |
| 4,218,013 | 8/1980 | Davison | 239/305 X |
| 4,358,056 | 11/1982 | Greenhut | 239/305 |

*Primary Examiner*—Robert G. Nilson
*Attorney, Agent, or Firm*—Linval B. Castle

[57] ABSTRACT

A personal shower fixture to be inserted between a shower pipe and shower head for introducing a selected one or a mixture of several fluids contained in the fixture into the water flow to the shower head. A venturi in the fixture draws the fluids into the flow through a conduit having branches in the fluid containers, each branch having a valve and the common branch into the venturi having a flow control valve. The fluid containers are supported in a cylindrical basket secured by a bayonet connector to the bottom of the fixture body, the basket having a fluid sight gauge and floor openings for easy removal of a container. There are no check valves in the conduit system so that the conduit and its branches may be easily cleaned by merely blocking the shower head output to backflush the conduit system.

13 Claims, 2 Drawing Sheets

SHOWER HEAD DISPENSING FIXTURE

BRIEF SUMMARY OF THE INVENTION

This invention relates to personal shower fixtures that can selectively inject fluids such as shampoo into the the water flow and particularly to a dispensing fixture in which one or more fluids in separate containers in the fixture may be simultaneously selected for mixing into the flow.

There are many different types of shower head dispensing fixtures. Some fixtures, such as Conklin U.S. Pat. No. 3,713,585, employ gravity feed to dispense a selected fluid into the flow; some such as Heald U.S. Pat. No. 3,231,200 inject only a single fluid; and some such as Shaw U.S. Pat. No. 4,135,646 or Davidson U.S. Pat. No. 4,218,013, draw by venturi action only one fluid at a time from a plurality of fluid reservoirs. A few patents such as Meyer-Saladin U.S. Pat. No. 2,757,688 and Greenhut 4,358,056 contain means for mixing two or more fluids and drawing the mixture into the flow of shower water. The present invention is of this last type.

The shower head dispensing fixture to be described is a separate appliance which may be inserted into the plumbing between the shower pipe and the shower head. It contains a venturi which is connected to draw a controlled amount of fluids through a feed tube that branches into three separate small output tubes entering three fluid chambers. The output tube from each chamber is valved so that any one, or any mixture of two or three of the fluids, may pass into the feed tube and through the metering valve to the venturi and into the shower water flow.

The advantages of such a dispensing fixture are apparent. The chambers may, for example, contain liquid shampoo, body soaps, bath oils, etc., and it may be desired to either use one of the fluids at one time or to mix two or three together at one time. The fluid from any one of the chambers passing through the valve in the small output tube will instantly cease to flow to the venturi when the valve is closed thereby eliminating any possibility of an undesired mixing with other fluids subsequently selected.

The fixture has been thoroughly designed. The chambers are separate transparent containers supported in a thin tubular metal basket connected by a bayonet coupling to the base of the fixture. The basket has vertical sight gauge slots which extend under the bottom of the basket so that, when removed, a chamber may be pushed up to remove and refill. The extensive use of O-ring seals on all moving valve components in the fixture eliminate the possibility of fluid leakage from or into the fixture, and even more important, an undesired intermixing of fluids. There are no check valves in the system so that the fixture, after removal of the chambers, is very easily cleaned by merely blocking the water output of the shower head and back flushing shower water through the feed and chamber output tubes.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
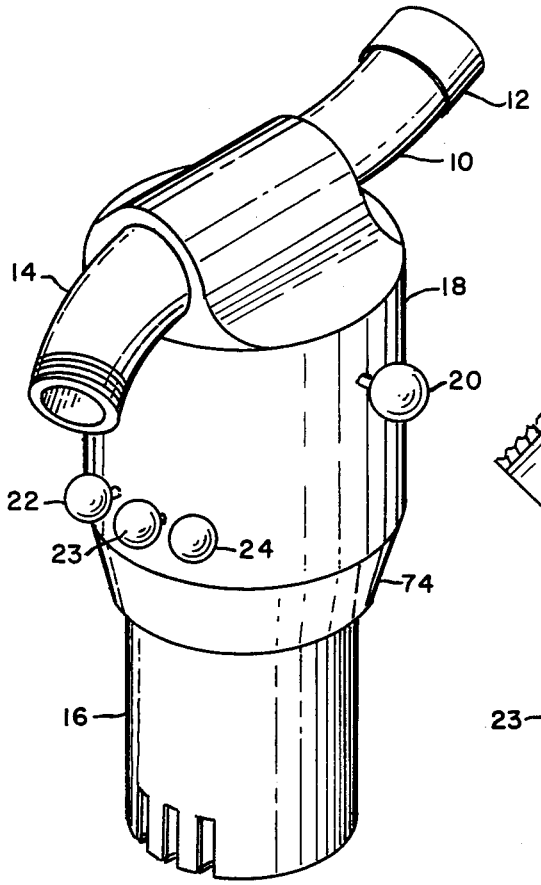
FIG. 1 is a perspective view of the shower head dispensing fixture.

FIG. 1 is a perspective view illustrating the exterior housing of the shower head dispenser and includes an input pipe 10 having a threaded female end coupling 12 which is screwed on the shower pipe after removal of the shower head, and a threaded output pipe 14 which is to receive the shower head. The dispensing fixture selectively injects one or any mixture of desired fluids that are held in three separate fluid chambers within a removable cylindrical basket 16 depending from the housing body 18. Within the body 18 are various selector valves controllable from knobs extending from the body surface. For example the the inward and outward movement of the knob 20 regulates the volume of fluid passing from the fluid chambers into the shower water flow; and the knobs 22, 23 and 24 are coupled to movable shafts which select which of the fluids will be mixed into the shower flow. It will be noted from FIG. 1 that all the knobs are readily accessible and easily located even with closed eyes.

Figure 3:
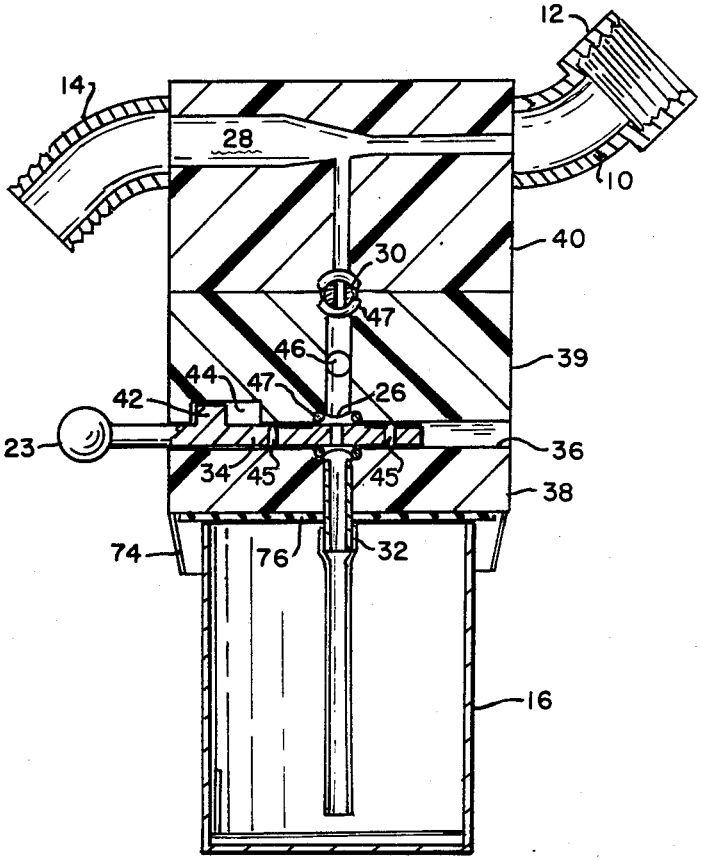
FIG. 3 is a sectional elevational view taken along the lines 3—3 of FIG. 2.
Figure 2:
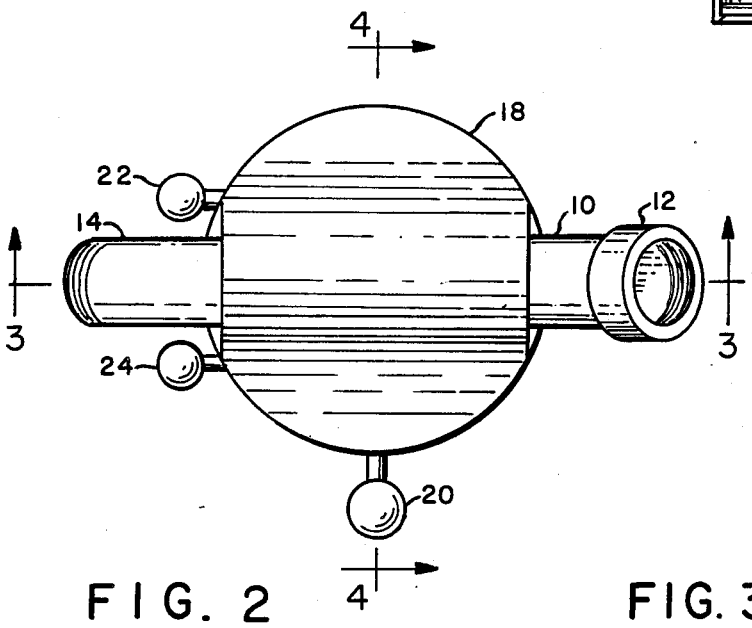
FIG. 2 is a top plan view thereof.

FIG. 2 is a plan view of the fluid dispenser and FIG. 3 is a sectional side view thereof taken through the lines 3—3 of FIG. 2 and illustrates the details of the selector switch 26 operated by the knob 23, the Venturi 28, and the volume regulating switch 30 controlled by the knob 20 of FIG. 1.

Figure 3A:
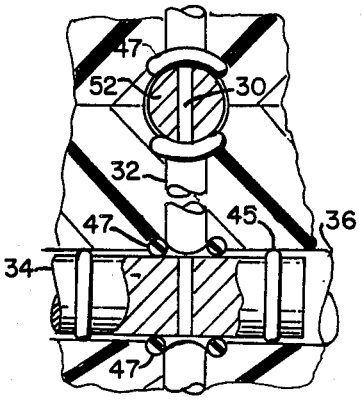
FIG. 3A is a sectional view of the fluid selector switches with the details of their O-ring seals.

The fluid selector switch 26 is an on-off valve in a conduit 32 that extends from a centrally located fluid chamber in basket 16 through the volume switch 30 and into the throat of a Venturi 28. Switch 26 is formed by a diametrical hole through a shaft 34 longitudinally slideable in a hole 36 that extends diametrically through the cylindrical housing body 18 in the interface of a lower section 38 and midsection 39 of the body. To prevent rotation of the shaft 34 and thus misalignment of the selector switch 26 in the conduit 32, and to provide for proper alignment of the switch hole in the conduit, a key 42 on the shaft 34 rides in a slot 44 formed in the interface of either the lower section 38 or midsection 39 and parallel with the axis of the hole 36. Thus, the knob 23 may adjust the shaft 34 so that the diametric hole in the shaft that forms the volume switch 30 is either aligned with the conduit 32 to admit fluid into the shower flow or misaligned to prevent fluid flow into the shower. To prevent leakage of any fluid from the dispenser, any accidental intermixing with other fluids, or introduction of moisture into the fixture, the shaft 34 is thoroughly sealed with O-ring seals 45 circumferentially located in grooves in the shaft at positions spaced from the conduit 32. Additional O-rings 47 surround the conduit 32 as best shown in FIG. 3A to be discussed. To provide relief so that the shaft 34 may easily be moved through the hole 36 without creating pressure or vacuum pockets, the hole 36, or at least an opening vent, must remain open on the side of the housing body opposite the knob 23.

FIG. 3A is a sectional view of a small portion of FIG. 3 and shows the O-ring placement in better detail. The fluid selector shaft 34 contains annular grooves in which O-rings are placed to prevent any transmission of fluid between the the area of the central selector switch 26 and the exterior of the fixture. However, O-rings placed around the shaft cannot prevent fluid leakage around a closed switch, since fluid can be drawn between the surface of the shaft 34 and the slightly larger hole 36 through which the shaft moves. To prevent this circumferential fluid leakage, O-rings 47 are pressed into arcuate counterbores around the conduit 32 at each location where the conduit meets a shaft. Because the O-ring surfaces must be shaped around the arcuate surface of the shaft, these rings are termed "saddle O-rings". These saddle O-rings 47 are shown located around the conduit 32 at locations above and below the fluid selector rod 34 and above and below the fluid flow valve rod 52 to be subsequently described.

The description of the remaining two fluid selector switches controlled by the knobs 22 and 24 is identical to the above described switch 26 operated by the knob 23. When fluid is selected by any one or more of the selector switches, the fluid from its respective fluid chamber is drawn up by the venturi action and enters a cross channel 46 diametrically cut through the midsection 39 of the housing body as best illustrated in FIG. 4.

Figure 4:
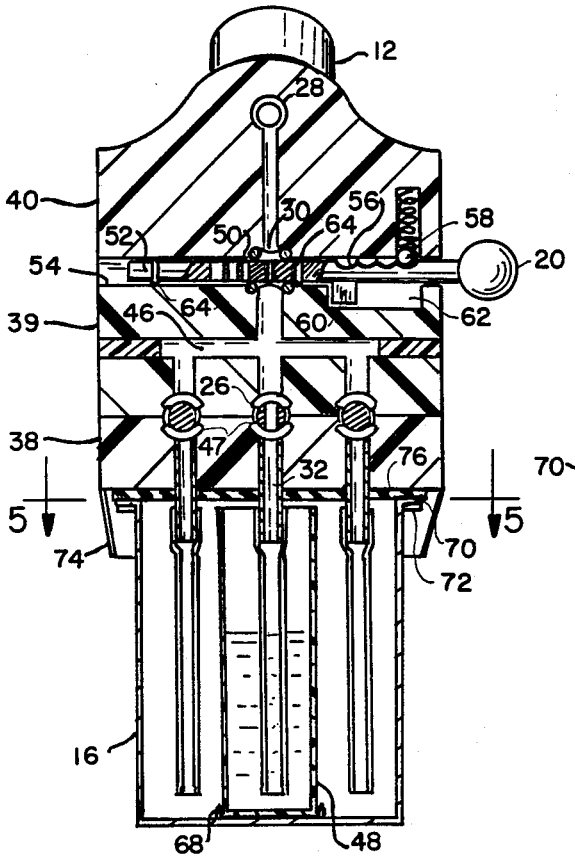
FIG. 4 is a sectional elevational view taken along the lines 4—4 of FIG. 2.

As shown in FIG. 4, the conduits 32 extend up through the selector switches 26 and are then intercoupled in the cross channel 46 which is preferably diametrically drilled completely through the midsection 39 and then plugged at the opposite ends to prevent leakage of fluids from the channel. The centrally located conduit 32 is shown with its lower end in a partially filled fluid chamber 48. After extending up through the selector valve 26 to the cross channel 46, conduit 32 continues to the volume regulator 50 which comprises a plurality of various diameter spaced diametrical holes in a shaft 52 slideable through a hole across the diameter of the housing body at the interface between the midsection 39 and upper section 40.

In the preferred embodiment, there are four holes of various diameters through the shaft 52 to provide for four different fluid flows to the Venturi 28. Each hole of the volume regulating switch is spaced along the shaft 52 and a selection of fluid flow is made by sliding the shaft 52 through the hole 54 to the point at which the desired hole is aligned with the vertical fluid conduit to the Venturi. To provide a means for proper alignment of the metering holes, the shaft 52 contains a plurality of surface notches 56 spaced along the shaft 52 identically to the spacing of the metering holes through the shaft. A spring biased detent ball 58 recessed into the upper section 40 engages one of the notches when one of the metering holes of the volume regulating switch 30 is properly aligned. As with the previously described fluid selector switches 26 of FIG. 3, the shaft 52 of the volume regulating switch 30 has a key 60 engaging a limit notch 62 for preventing rotation of the shaft 52 in the hole 54 and for limiting the longitudinal movement of the shaft through the hole. Also, as with the previously described fluid selector switches, the shaft 52 is thoroughly sealed with O-rings 64 in annular grooves around the shaft and the conduit 32 contains saddle O-rings 47 as shown in FIG. 3A to prevent circumferential leakage around the shaft.

Figure 5:
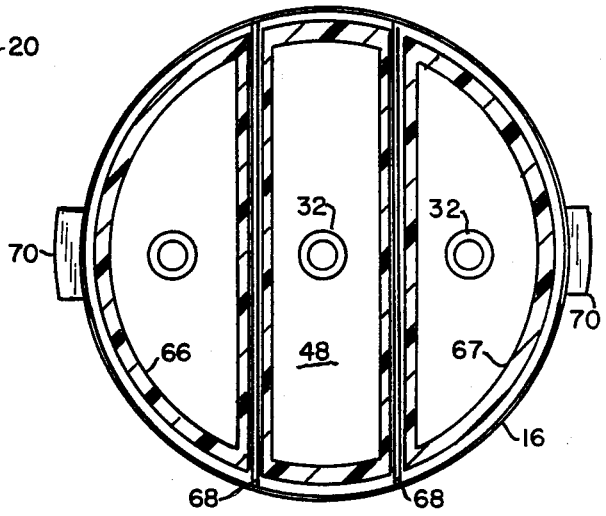
FIG. 5 is a plan view of only the fluid chamber basket taken along the lines 5—5 of FIG. 4.

FIG. 5 is a plan view of the cylindrical basket 16 taken along the lines 5—5 of FIG. 4 and shows the conduits 32 in the center of three fluid chambers 48, 66 and 67. The chambers are preferably plastic and are translucent or transparent so that their fluid levels can be viewed through the basket openings. Each chamber is removable from the basket and each is separated from its neighbor by a small fence or divider 68 formed in the floor of the basket 16 to assure alignment of the chambers and to prevent their rotation in the basket. At the top rim of the basket are a pair of oppositely positioned tabs 70 which are grasped by clips 72 secured to the bottom surface of the lower section 38 to form a bayonet connection. For additional security, additional pairs of oppositely positioned tabs 70 may be evenly spaced around the rim of the basket to engage correspondingly spaced clips secured to the bottom of the lower section 38.

As shown in FIGS. 3 and 4, the bayonet coupling of the cylindrical basket to the bottom of the lower housing section 38 is surrounded by an apron 74 and the top open surface of the basket 16 contacts a thin resilient foam cushion 76 at the bottom surface of the lower housing section 38. When mounting or disconnecting the basket 16 from the dispenser housing the bayonet tabs 70 on the rim of the basket must be lifted over the ledges of the bayonet latching clips 72 so that the basket is forced up against the resiliency of the cushion 76. The purpose of the apron 74 is therefore to provide a shield to prevent shower water from soaking the cushion and entering the fluid chambers.

Figure 6:
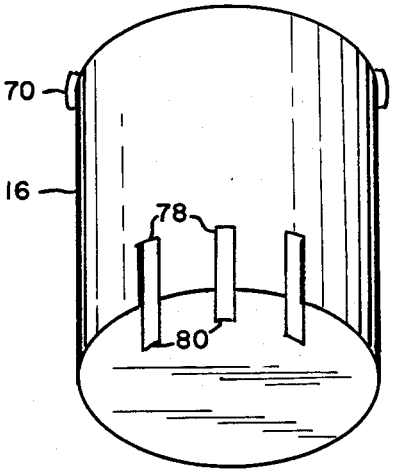
FIG. 6 is a perspective view of the chamber basket showing a side and the bottom surface.

FIG. 6 is a perspective view of the basket 16 and shows vertical slots 78 which provide sight gauges for the fluid chambers contained within. The vertical slots extend down to become bottom slots 80 in the bottom surface of the basket. These serve to assist in removing a chamber from the basket and may, of course, be openings or holes beneath each chamber that are not necessarily connected to the vertical sight gauge slots 78. The basket of FIG. 6 also illustrates the bayonet tabs 70 extending out at the top rim of the basket.

Figure 7:
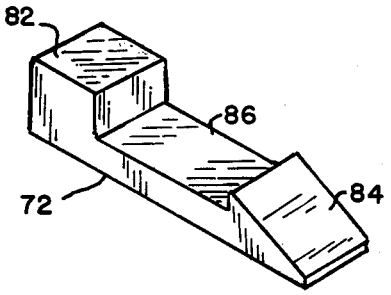
FIG. 7 is a perspective view illustrating one basket bayonet lock.

FIG. 7 is a perspective view of a bayonet clip 72 which has a top surface 82 connected to the bottom surface of the lower housing section 38. The clip is preferably formed with an angled ramp 84 which terminates in a drop step to a flat section 86 having a length substantially corresponding to the length of a bayonet tab 70 around the rim of the basket 16. To install the basket on the dispenser, it is only necessary to position the tabs 70 against the lower ends of the ramps 84 and rotate the basket so that the tabs 70 ride up the ramp and drop into the flat section 86 where they become locked by the downward force of the resilient foam material 76 and the step from the ramp to the flat section. To remove the basket, it is necessary to force the basket upward against the resilient foam material so that the bayonet tabs 70 are lifted back up over the step to the ramp 84 where a small counterclockwise rotation of the basket will release it from the dispenser.

What is claimed:

1. A personal shower fixture insertable between a shower water input pipe and a shower head for introducing selected fluids into the water flow to the shower head, said fixture comprising:

a housing having a water input pipe and output pipe;

a venturi between said input pipe and output pipe;

a plurality of fluid chambers;

a fluid conduit having a first end and a plurality of second end branches, each of said plurality of second end branches terminating in one of said plurality of chambers, the first end of said fluid conduit terminating in the throat of said venturi;

a manually operable on-off switch in each of said plurality of second end branches for selecting fluid from one or more of said plurality of fluid chambers to be drawn through said conduit into said venturi and into the water flow to the shower head;

said manually operable on-off switch comprising a valve rod slideable through a valve rod hole through said housing and normal to said conduit branch, said valve rod having an opening alignable with said conduit branch and having sealing means for preventing leakage of fluid between said rod and said valve rod hole; and a manually operable flow regulator in said fluid conduit for controlling the amount of fluid drawn from said fluid chambers into said venturi.

2. The fixture claimed in claim 2 wherein said valve rod is prevented from rotation in said valve rod hole and is limited in movement through said valve rod hole by a key extending from said valve rod and engaging an adjacent elongated key slot in said housing.

3. The fixture claimed in claim 2 wherein said flow regulator is a rod having a plurality of different size diametrical holes spaced apart along a portion of its length, said rod being slideable through a flow rod hole through said housing to align one of said diametrical holes with said single conduit, said flow regulator rod having a plurality of detent depressions in its surface, said depressions having substantially the same spacing as said diametrical holes, each depression being selectable by a spring biased detent ball in said housing, said flow regulator rod having sealing means for preventing leakage of fluids between said rod and said flow rod hole.

4. The fixture claimed in claim 3 wherein said flow regulator rod is prevented from rotation in said flow rod hole and is limited in movement through said flow rod hole by a key extending from said flow regulator rod and engaging an adjacent elongated slot in said housing.

5. The fixture claimed in claim 1 wherein said plurality of fluid chambers are translucent to transparent and are contained in a basket depending from said housing, said basket having visible openings adjacent lower ends of said chambers for viewing said chambers and the level of fluids therein.

6. The fixture claimed in claim 5 wherein said basket is cylindrical and is coupled to the lower surface of said housing by a bayonet connection.

7. The fixture claimed in claim 6 wherein said plurality of fluid chambers are three in number, said three chambers being formed to fit within said cylindrical basket, and wherein the interior floor of said basket contains raised dividers to prevent movement of said chambers within said basket.

8. The fixture claimed in claim 6 further including a resilient pad interposed between said basket the the lower surface of said housing.

9. The fixture claimed in claim 8 further including a short apron surrounding the lower portion of said housing and upper portion of said basket for deflecting water from said resilient pad.

10. The fixture claimed in claim 9 further including openings in the bottom surface of said basket and substantially centered under each of said plurality of fluid chambers for manually urging a chamber from said basket when said basket is removed from said housing.

11. A personal shower fixture insertable between a shower water input pipe and a shower head for introducing one or more selected fluids into the water flow to the shower head, said fixture including:

a housing containing a water input pipe and output pipe and having a top area and a bottom surface;

a venturi in the top area of said housing and located between said input pipe and output pipe, said venturi having a throat for developing a suction pressure during a flow of water through the venturi;

a basket having a cylindrical wall, a circular floor and an open top, said top being removably coupled to the bottom surface of said housing;

a plurality of fluid containing chambers formed to fit in said basket, said chambers having open tops;

a fluid conduit having a first end terminating in the throat of said venturi and a plurality of second end branches, each branch being inserted into one of said plurality of fluid chambers;

an on-off valve in each of said plurality of second end branches for selecting fluids to be drawn into the flow of water by said venturi, said fluid conduit branches being joined into one common conduit above said on-off valves; and a fluid flow control valve in said common conduit for regulating the amount of fluids being drawn into the flow of water by said venturi.

12. The fixture claimed in claim 11 wherein said on-off valve and said flow control valve are rods longitudinally moveable manually through holes in said housing, said rods having diametrical holes selectably alignable with said fluid conduit.

13. The fixture claimed in claim 12 further including O-rings located in annular grooves around said rods and saddle O-rings around said fluid conduit and contacting the surfaces of said rods.

* * * * *